US010920511B2

(12) United States Patent
Bonavides et al.

(10) Patent No.: US 10,920,511 B2
(45) Date of Patent: Feb. 16, 2021

(54) TOOL POSITIONING DEVICES FOR OIL AND GAS APPLICATIONS

(71) Applicant: Saudi Arabian Oil Company, Dhahran (SA)

(72) Inventors: Clovis Satyro Bonavides, Dhahran (SA); Vladislav Torlov, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 70 days.

(21) Appl. No.: 16/233,251

(22) Filed: Dec. 27, 2018

(65) Prior Publication Data

US 2020/0208508 A1 Jul. 2, 2020

(51) Int. Cl.

| | |
|---|---|
| ***E21B 23/01*** | (2006.01) |
| ***E21B 47/01*** | (2012.01) |
| ***E21B 47/04*** | (2012.01) |
| ***E21B 47/09*** | (2012.01) |

(52) U.S. Cl.

CPC ..... *E21B 23/01* (2013.01); *E21B 47/01* (2013.01); *E21B 47/04* (2013.01); *E21B 47/09* (2013.01)

(58) Field of Classification Search

CPC ..... E21B 47/09; E21B 47/01; E21B 47/04; E21B 47/013; E21B 23/01; E21B 17/10; E21B 17/1021; E21B 17/1028; E21B 17/073; E21B 25/16; E21B 4/18; E21B 49/06

See application file for complete search history.

(56) References Cited

U.S. PATENT DOCUMENTS

| | | | | |
|---|---|---|---|---|
| 2,994,770 | A | 8/1961 | Monaghan et al. | |
| 5,541,587 | A | 7/1996 | Priest | |
| 5,629,480 | A | 5/1997 | Herget | |
| 6,173,773 | B1 | 1/2001 | Almaguer et al. | |
| 6,655,458 | B2 * | 12/2003 | Kurkjian | E21B 23/01 166/254.2 |
| 7,343,977 | B2 | 3/2008 | Martin et al. | |
| 7,886,842 | B2 | 2/2011 | Howard et al. | |
| 7,933,166 | B2 | 4/2011 | Goodman | |
| 9,182,517 | B1 | 11/2015 | Selman et al. | |
| 9,689,256 | B2 | 6/2017 | Tevis | |
| 2005/0139357 | A1 * | 6/2005 | Martin | E21B 17/073 166/301 |

(Continued)

FOREIGN PATENT DOCUMENTS

| | | |
|---|---|---|
| GB | 2300441 | 11/1996 |
| WO | 2009014932 | 1/2009 |

OTHER PUBLICATIONS

International Search Report and Written Opinion issued in International Application No. PCT/US2019/067805 dated Apr. 21, 2020, 12 pages.

(Continued)

*Primary Examiner* — George S Gray
(74) *Attorney, Agent, or Firm* — Fish & Richardson P.C.

(57) ABSTRACT

A positioning device for adjusting an axial position of a tool within a wellbore includes an anchor configured for attachment to the wellbore at a fixed axial location within the wellbore, a shaft coupled to the anchor, and a coupling member to which the tool is rigidly attached. The coupling member is configured to be translated along the shaft to adjust the axial position of the tool with respect to the fixed axial location of the anchor within the wellbore.

20 Claims, 4 Drawing Sheets

(56) References Cited

U.S. PATENT DOCUMENTS

| | | | |
|---|---|---|---|
| 2009/0025941 | A1 | 1/2009 | Iskander |
| 2011/0107830 | A1 | 5/2011 | Fields et al. |
| 2013/0081803 | A1 | 4/2013 | Tao et al. |
| 2014/0174759 | A1 | 6/2014 | Harrigan |
| 2017/0167235 | A1 | 6/2017 | Jong et al. |
| 2018/0003032 | A1 | 1/2018 | Donzier et al. |
| 2019/0316432 | A1 | 10/2019 | Michaud |

OTHER PUBLICATIONS

Schlumberger, "WPP: Wireline perforating platform," slb.com/perforating, Schlumberger, 14-PE-0011, 2014, 2 pages.
International Search Report and Written Opinion issued in International Application No. PCT/US2020/016508 dated May 28, 2020, 13 pages.

* cited by examiner

TOOL POSITIONING DEVICES FOR OIL AND GAS APPLICATIONS

TECHNICAL FIELD

This disclosure relates to downhole tool positioning devices for oil and gas applications.

BACKGROUND

Properties of a rock formation may be tested using various downhole logging tools by deploying such tools to desired depths within the rock formation and then operating the tools to produce measurements. Accurately controlling a depth of a logging tool can be a difficult task, depending on certain features of a tool positioning device (for example, fixed positional increments) and certain features of a rock formation (for example, a thickness of a formation bed or lamination layer, a shape of a wellbore, or a bed boundary location). Furthermore, attempts to test a rock formation are often unsuccessful due to poor depth control of a logging tool within a wellbore, which can result in an inaccurate or otherwise unfavorable position of the logging tool.

SUMMARY

This disclosure relates to positioning devices for precisely changing a depth of a tool attached thereto within a wellbore of a formation. An example tool positioning device includes a housing, an anchor carried by the housing that attaches the housing to the wellbore at a selected axial reference position, a motor that is attached to the anchor, a screw that is rotated by the motor, and a nut surrounding the screw that is translatable axially according to a rotation of the screw for changing an axial position of the nut relative to the axial reference position. The nut is rigidly attached to the tool such that movement of the nut results in a corresponding movement of the tool within the wellbore.

In one aspect, a positioning device for adjusting an axial position of a tool within a wellbore includes an anchor configured for attachment to the wellbore at a fixed axial location within the wellbore, a shaft coupled to the anchor, and a coupling member to which the tool is rigidly attached, the coupling member configured to be translated along the shaft to adjust the axial position of the tool with respect to the fixed axial location of the anchor within the wellbore.

Embodiments may provide one or more of the following features.

In some embodiments, the shaft includes multiple threads by which the coupling member is secured to the shaft.

In some embodiments, the positioning device further includes a motor configured to rotate the shaft, the motor being attached to the anchor.

In some embodiments, the positioning device is configured such that a rotational movement of the shaft causes an axial movement of the coupling member.

In some embodiments, the positioning device further includes a housing that carries the anchor.

In some embodiments, the housing defines a first fluid chamber located between the anchor and the coupling member, and wherein the coupling member defines an interior region that provides a second fluid chamber that is fluidically coupled to the first fluid chamber.

In some embodiments, the positioning device further includes a piston that cooperates with the housing to define a fluid reservoir that is fluidically coupled to the first and second fluid chambers.

In some embodiments, the positioning device further includes oil disposed within the fluid reservoir and within the first and second fluid chambers.

In some embodiments, a first volume of the first fluid chamber is variable and a reservoir volume of the fluid reservoir is variable.

In some embodiments, a total volume of the oil within the fluid reservoir and within the first and second fluid chambers is fixed.

In some embodiments, the first volume increases as the reservoir volume decreases, and wherein the first volume decreases as the reservoir volume increases.

In some embodiments, the piston is movable axially to equalize a first pressure of the oil and a second pressure of a wellbore fluid within the wellbore that is isolated from the oil by the piston within the positioning device.

In some embodiments, the axial position defines a vertical depth within the wellbore.

In some embodiments, the shaft is located above the anchor such that the tool is located above the positioning device.

In some embodiments, the shaft is located below the anchor such that the tool is located below the positioning device.

In some embodiments, the positioning device further includes an extendable member that extends along the shaft and provides electrical signals to the tool.

In some embodiments, the coupling member includes a nut surrounding the shaft.

In some embodiments, the positioning device is configured to be motor-activated.

In another aspect, a method of operating a positioning device to adjust an axial position of a tool within a wellbore includes attaching an anchor of the positioning device to the wellbore at a fixed axial location, activating a shaft of the positioning device that is coupled to the anchor, and translating a coupling member of the positioning device along the shaft with respect to the fixed axial location of the anchor, the coupling member being rigidly attached to the tool such that the axial position of the tool is translated with respect to the fixed axial location of the anchor.

The details of one or more embodiments are set forth in the accompanying drawings and description. Other features, aspects, and advantages of the embodiments will become apparent from the description, drawings, and claims.

DETAILED DESCRIPTION

Figure 1:
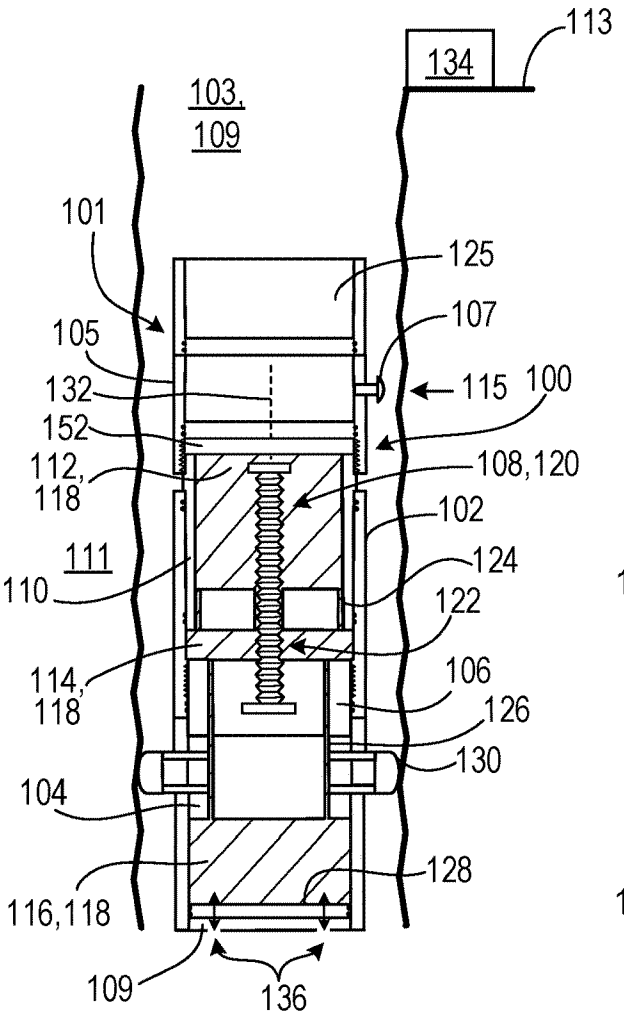
FIG. 1 is a cross-sectional view of an example tool positioning device in a first configuration in which a tool attached to the tool positioning device is located at a first axial position within a wellbore, for which the tool positioning device is motor-activated, and for which a motor of the tool positioning device is located above an anchor of the tool positioning device.
Figure 2:
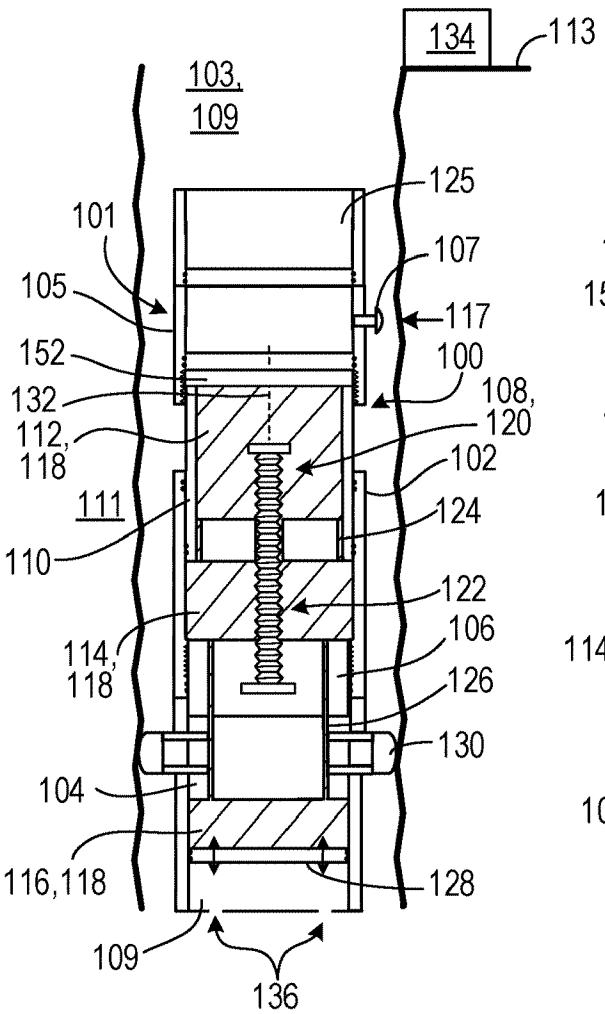
FIG. 2 is a cross-sectional view of the tool positioning device of FIG. 1 in a second configuration in which the tool is located at a second axial position above the first axial position within the wellbore.
Figure 3:
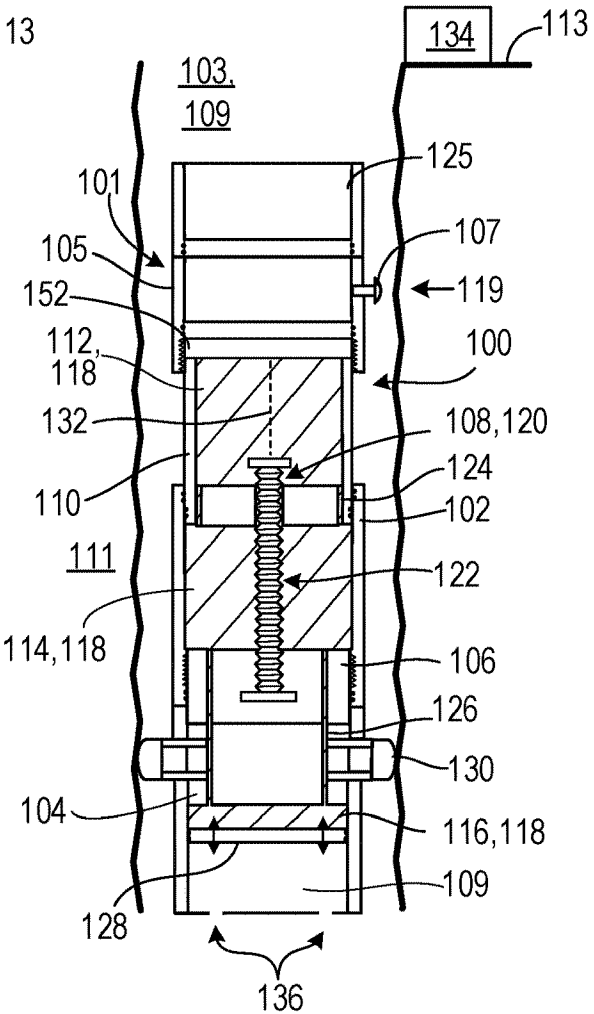
FIG. 3 is a cross-sectional view of the tool positioning device of FIG. 1 in a third configuration in which the tool is located at a third axial position above the second axial position within the wellbore.

FIGS. 1-3 illustrate multiple states of a tool positioning device 100 designed for precisely changing a depth of a tool 101 (for example, a logging tool) attached to the tool positioning device 100 within a wellbore 103 of a rock formation 111. The tool positioning device 100 includes a housing 102, an anchor 104 by which the housing 102 is attached to the wellbore 103 at a selected depth, a motor 106 that is attached to the anchor 104, a control system 134 that is electrically coupled to the motor 106, a screw 108 that is rotated by the motor 106, and a nut 110 surrounding the screw 108 that is translatable axially according to a rotation of the screw 108 for changing the depth of the nut 110. The nut 110 is rigidly attached to the tool 101 such that movement of the nut 110 results in a corresponding movement of the tool 101 within the wellbore 103.

Example tools 101 that may be coupled to the tool positioning device 100 within the wellbore 103 include measurement tools (for example, a formation tester, such as a probe with a packer), a stationary survey tool, a coring bit, or a type of actuating device. The tool 101 includes a tool body 105 that is rigidly attached to the tool positioning device 100 and a test probe 107 that is carried by the tool body 105. One or more additional tools 125 (for example, telemetry, gamma ray, and caliper tools) may be attached to the tool 101 along a top portion of the tool body 105 within the wellbore 103.

The tool positioning device 100 defines an upper fluid chamber 112, a lower fluid chamber 114, and a fluid reservoir 116 that are fluidly coupled to one another by upper fluid channels 124 and lower fluid channels 126. The upper fluid chamber 112 coincides with an interior region of the nut 110 and contains oil 118 (for example, hydraulic oil) that protects an upper portion 120 of the screw 108 within the interior region of the nut 110. For example, a top boundary of the upper fluid chamber 112 is formed by a cap 152 of the nut 110. In some embodiments, the cap 152 is a removable cap with one or more sealing elements (for example, o-rings) that facilitate mechanical and/or electrical attachment of the tool positioning device 100 to the tool body 105 without modification of the tool body 105. The lower fluid chamber 114 is defined by an inner surface of the housing 102 and also contains oil 118 that protects a lower portion 122 of the screw 108 located outside of the nut 110. The oil 118 surrounding the upper and lower portions 120, 122 of the screw 108 provides a safe environment that protects the screw 108 from wellbore fluid 109 and contaminants. The fluid reservoir 116 is also defined laterally by the inner surface of the housing 202 and supplies oil 118 to the lower fluid chamber 114 via the lower fluid channels 126 that extend through the motor 106 and the anchor 104. The lower fluid chamber 114 supplies oil 118 to the upper fluid chamber 112 via the upper fluid channels 124.

The tool positioning device 100 further includes a piston 128 (for example, a floating piston) that isolates the fluid reservoir 116 from wellbore fluid 109 that can enter the housing 102 through openings 136 in the housing 102. The piston 128 is free to move under an effect of a pressure differential between the wellbore fluid 109 and a pressure of the oil 118 within the fluid reservoir 116 such that the piston 128 shifts axially to equalize the pressure of the wellbore fluid 109 and the pressure of the oil 118. A total amount of oil 118 within the fluid reservoir 116 and the fluid chambers 112, 114 is fixed once the anchor 103 is deployed (for example, fixed) along the wellbore 103, and the fluid reservoir 116 and the fluid chambers 112, 114 are in fluid (for example, hydraulic) communication with each other. Axial movement of the nut 110 and the tool 101 attached thereto changes adjacent volumes of oil 118 within the upper and lower fluid chambers 112, 114, as will be discussed in more detail below.

The housing 102 of the tool positioning device 100 carries the anchor 104, and the anchor 104 is securable to the wellbore 103 at attachment elements 130 to provide a fixed axial position (for example, a reference position) of the tool positioning device 100 (for example, a fixed position of the housing 102) relative to the wellbore 103. In some embodiments, the anchor 104 may include a dedicated actuating motor that is separate from the motor 106. Example attachment elements 130 include anchoring arms that may include pads or may include pistons that have biting elements to enhance attachment to the wellbore 103. The motor 106 is rigidly attached to the anchor 104, and the screw 108 is axially fixed with respect to the motor 106. The control system 134 is located at or above a surface 113 of the rock formation 111 (for example, installed within a movable service unit, such as a truck or a transportable cabin) and is coupled to the motor 106 via a wireline (not shown). In some implementations, the control system 134 sends actuation commands through a wellbore mud system using telemetry components (for example, a mud pulser) that are commonly used in measurements while drilling. In such cases, a power system of the tool positioning device 100 may include downhole batteries or turbines.

In operation of the tool positioning device 100, the motor 106 (for example, which may be coupled to a gearbox) is controlled by the control system 134 to rotate (for example, spin) the screw 108 about a central axis 132 of the screw 108 (for example, coinciding with a central axis of the tool positioning device 100). The control system 134 measures a rotational movement of the screw 108 such that the rotational movement of the screw 108 is converted to translational movement (for example, vertical axial movement) of the nut 110 along the screw 108. The vertical displacement of the nut 110 is controlled by a number of revolutions that the screw 108 rotates about the axis 132 and by a known thread pitch of the screw 108. The number of revolutions can be measured by a rotation encoder. Accordingly, a length of the screw 108 determines a total extent to which the nut 110 can move axially, and the thread pitch of the screw 108 determines a distance by which the nut 110 can move axially per revolution of the screw 108.

FIGS. 1-3 respectively illustrate the test probe 107 of the tool 101 at three different vertical positions (for example, formation bed depths) 115, 117, 119 within the wellbore 103. As the nut 110 moves axially away (for example, upward) from the motor 106, a volume of oil 118 within the upper fluid chamber 112 increases (for example, according to a volume of the screw 108 that is no longer disposed within the interior region of the nut 110), a volume of the lower fluid chamber 114 increases, and the piston 128 shifts upward such that a volume of the fluid reservoir 116 also decreases. As the piston 128 shifts upward to equalize the pressure of the oil 118 and the pressure of the wellbore fluid 109, oil 118 within the fluid reservoir 116 is forced to flow upward through the lower fluid channels 126 into the lower fluid chamber 114, and oil within the lower fluid chamber 114 is forced to flow upward through the upper fluid channels 124 into the upper fluid chamber 112.

The housing 102 of the tool positioning device typically has an outer diameter of about 8 centimeters (cm) to about 15 cm and a wall thickness of about 0.5 cm to about 1.5 cm. The upper fluid channels 124 typically have a diameter of about 0.5 millimeters (mm) to about 5 mm, and the lower fluid channels 126 typically have a diameter of about 0.5 mm to about 5 mm. The screw 108 typically has an operational length (for example, a length along which the nut 110 can translate) of about 0.5 meters (m) to about 2.5 m. The total volume of oil 118 within the tool positioning device 100 (for example, a total volume of the fluid chambers 112, 114 and the fluid reservoir 116) typically falls within a range of about 10 liters (L) to about 50 L. Example materials from which the screw 108 and the nut 110 are typically made include high grade steel, among other materials.

Figure 6:
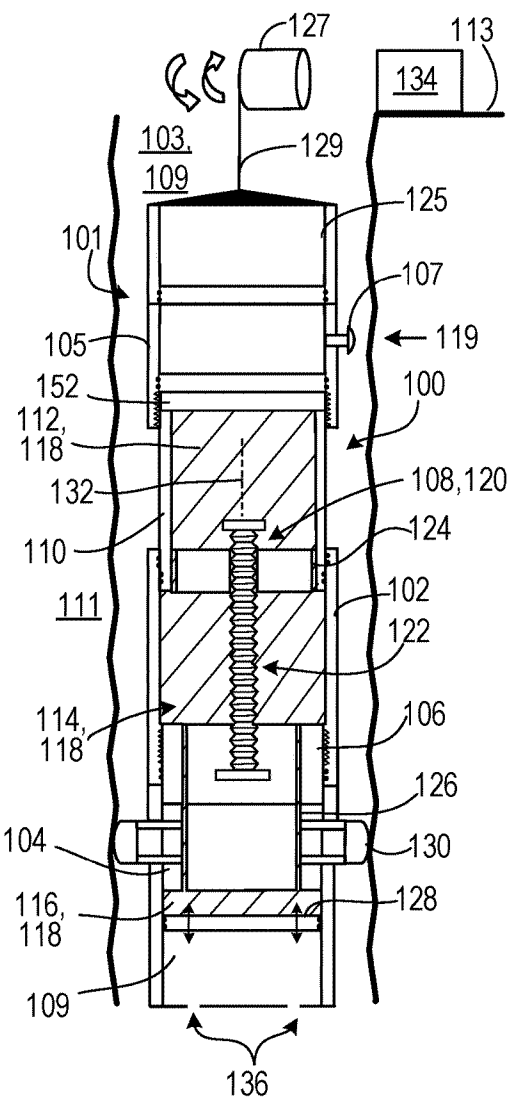
FIG. 6 is a cross-sectional view of the tool positioning device of FIG. 1 in the third configuration, for which the tool positioning device is winch-activated.
Figure 5:
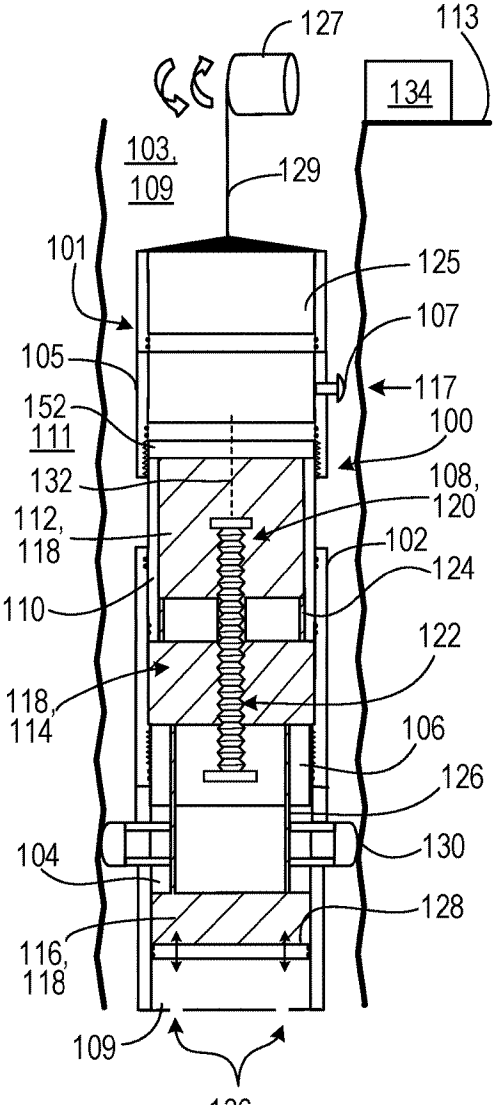
FIG. 5 is a cross-sectional view of the tool positioning device of FIG. 1 in the second configuration, for which the tool positioning device is winch-activated.
Figure 4:
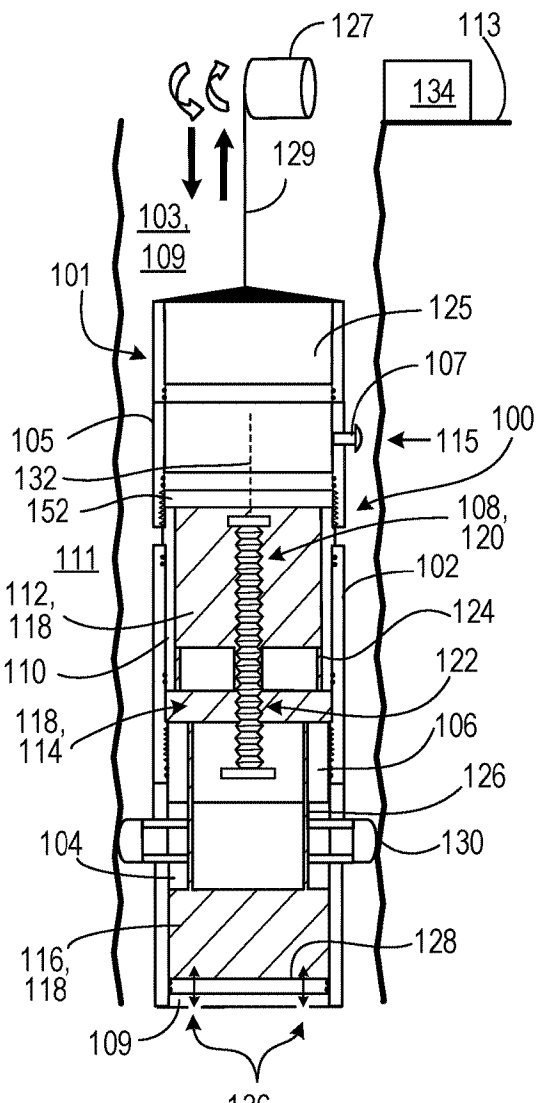
FIG. 4 is a cross-sectional view of the tool positioning device of FIG. 1 in the first configuration, for which the tool positioning device is winch-activated.

While operation of the tool positioning device 100 has been described as being driven by the motor 106, in some embodiments, operation of the tool positioning device 100 may be driven by a cable adjustment device located at the surface 113 of the rock formation 111, without activation of the motor 106. For example, FIGS. 4-6 illustrate multiple states of the tool positioning device 100 in which the tool positioning device 100 is coupled to a winch 127 located at the surface 113 of the rock formation 111. The winch 127 is designed to wind (for example, pull upward) and unwind (for example, release downward according to the force of gravity) a cable 129 (for example, a wireline, a tubing, or a pipe) that is connected to the tool body 105 of the tool 101. Due to a rigid connection between the tool 101 and the nut 110, vertical movement of the cable 129 and the tool 101 results in a corresponding vertical movement (for example, translation) of the nut 110 along the axis 132 of the screw 108 such that the screw 108 rotates without activation of the motor 106. The winch 127 can be locked for movement once the tool 101 is located at a desired depth within the wellbore 103. A locking mechanism of the winch 127 is controlled at the surface 113 of the rock formation 111.

In some examples, the tool positioning device 100 may be operated using the winch 127 instead of the motor 106 for wellbores of vertical orientation (for example, the wellbore 103) or in wellbores with low deviation, where cable tension can be effectively transferred from a surface of the formation. In some embodiments, a tool positioning device that is otherwise similar in construction and function to the tool positioning device 100 may not include the screw 108 and may include a sliding screw or a very low friction ball screw mechanism. Such a tool positioning device may be activated by a surface winch using the sliding sleeve or the ball screw mechanism. For example, the nut in the ball screw may hold the tool to be shifted, and the tool will normally be located with the sleeve fully deployed or with the ball screw located at an upper end of the screw. Such a ball screw mechanism can allow the nut (for example, and the tool that is rigidly attached to the nut) to slide along the screw almost freely. The tool positioning device 100 is locked while in travel mode. That is, the attachment elements 130 of the anchor 104 are retracted such that the tool positioning device 100 can move axially within the wellbore 103, while the screw 108 is locked to prevent rotation of the screw 108 and vertical movement of the nut 110 during the axial movement. Such locking can be accomplished using a clutching mechanism, such as a magnetic clutch.

Figure 9:
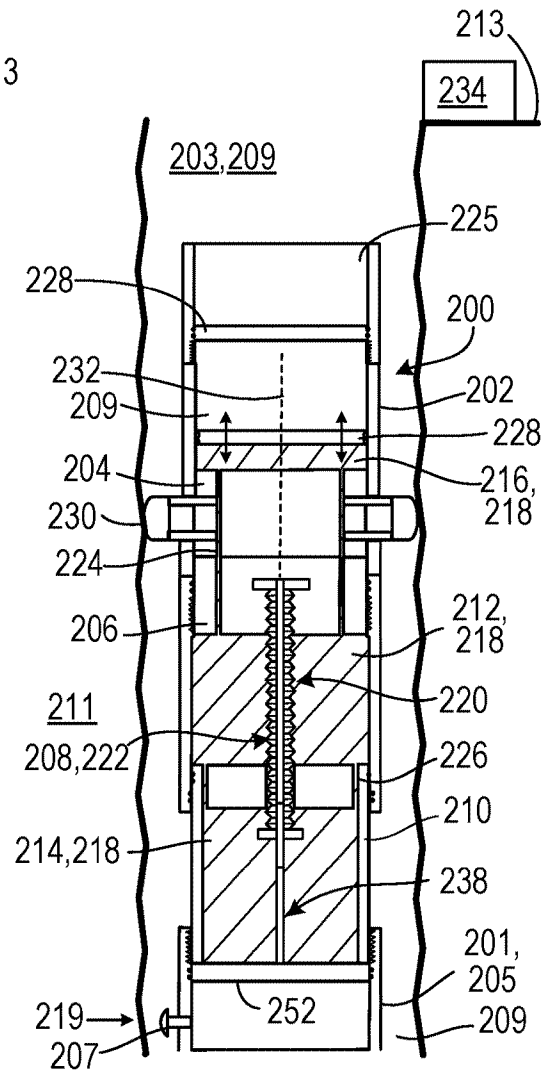
FIG. 9 is a cross-sectional view of the tool positioning device of FIG. 7 in a third configuration in which the tool is located at a third axial position below the second axial position within the wellbore.
Figure 8:
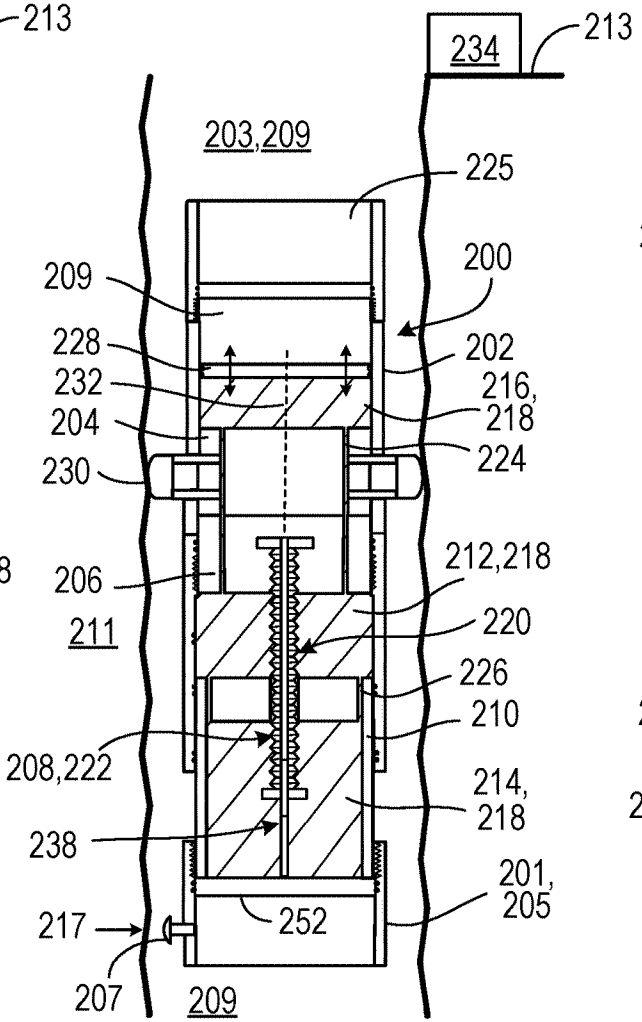
FIG. 8 is a cross-sectional view of the tool positioning device of FIG. 7 in a second configuration in which the tool is located at a second axial position below the first axial position within the wellbore.
Figure 7:
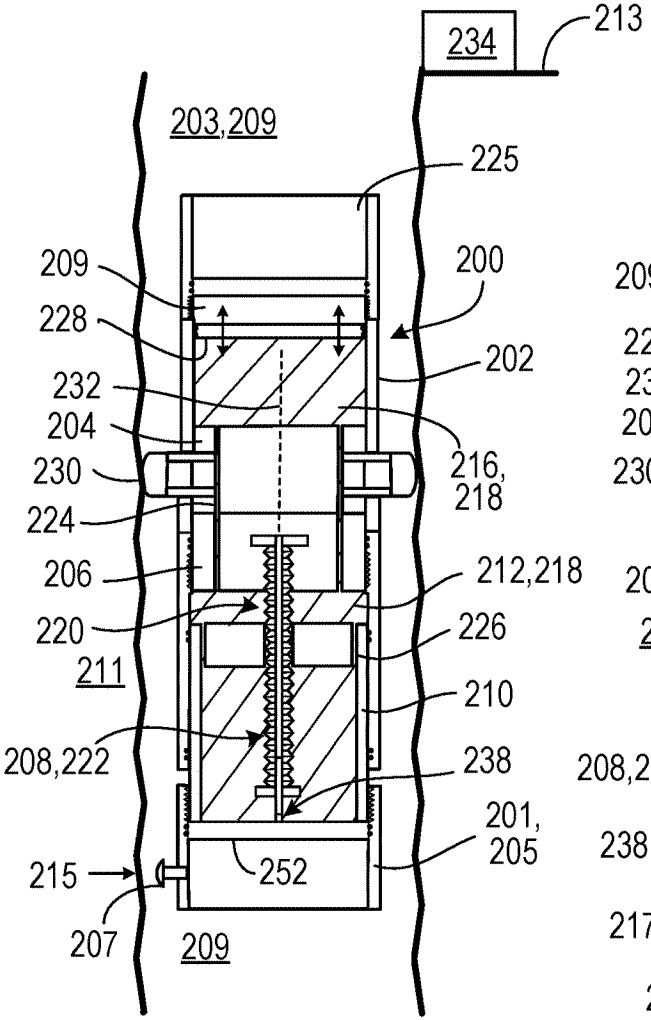
FIG. 7 is a cross-sectional view of an example tool positioning device in a first configuration in which a tool attached to the tool positioning device is located at a first axial position within a wellbore, for which the tool positioning device is motor-activated, and for which a motor of the tool positioning device is located below an anchor of the tool positioning device.

While the tool positioning device 100 has been described and illustrated with the motor 106 located above the anchor 104, in some embodiments, a tool positioning device includes a motor that is located below an anchor. For example, FIGS. 7-9 illustrate multiple states of a tool positioning device 200 for which a motor 206 is located below an anchor 204. The tool positioning device 200 is otherwise substantially similar in structure and function to the tool positioning device 100 and accordingly is designed for precisely changing a depth of a tool 201 (for example, a logging tool) attached to the tool positioning device 200 below the anchor 204 within a wellbore 203 of a rock formation 211. For example, the tool positioning device 200 further includes a housing 202, a control system 234, a screw 208, a nut 210, and oil 218 that are substantially similar in structure and function to the housing 102, the screw 108, the nut 110, and the oil 118, except in arrangement with respect to the anchor 204. The tool 201 includes a tool body 205 that is rigidly attached to the tool positioning device 200 and a test probe 207 that is carried by the tool body 205. One or more additional tools 225 (for example, telemetry, gamma ray, and caliper tools) may be attached to the tool positioning device 200 along a top portion of the housing 202 within the wellbore 203. In such embodiments, wiring may be embedded in the housing 202 to allow simplification of a mechanical design of a pressure compensating system.

The tool positioning device 200 defines an upper fluid chamber 212, a lower fluid chamber 214, and a fluid reservoir 216 that are fluidly coupled to one another by upper fluid channels 224 and lower fluid channels 226. The lower fluid chamber 214 coincides with an interior region of the nut 210 and contains oil 218 (for example, hydraulic oil) that protects a lower portion 222 of the screw 208 within the interior region of the nut 210. For example, a lower boundary of the lower fluid chamber 214 is formed by a cap 252 of the nut 210. The upper fluid chamber 212 is defined by an inner surface of the housing 202 and also contains oil 218 that protects an upper portion 220 of the screw 208 located outside of the nut 210. The oil 218 surrounding the upper and lower portions 220, 222 of the screw 208 provides a safe environment that protects the screw 208 from wellbore fluid 209 and contaminants. The fluid reservoir 216 is also defined by the inner surface of the housing 202 and supplies oil 218 to the upper fluid chamber 212 via the upper fluid channels 224 that extend through the motor 206 and the anchor 204. The upper fluid chamber 212 supplies oil 218 to the lower fluid chamber 214 via the lower fluid channels 226.

The tool positioning device 200 further includes a piston 228 (for example, a floating piston) located above the anchor 204 that isolates the fluid reservoir 216 from wellbore fluid 209 above the tool positioning device 200. The piston 228 shifts axially to equalize a pressure of wellbore fluid 209 and a pressure of the oil 218. A total amount of oil 218 within the fluid reservoir 216 and the fluid chambers 212, 214 is fixed once the anchor 203 is deployed (for example, fixed) along the wellbore 203, and the fluid reservoir 216 and the fluid chambers 212, 214 are in fluid (for example, hydraulic) communication with each other. Axial movement of the nut 210 (for example, and the tool 201 attached thereto) changes adjacent volumes of oil 218 within the lower and upper fluid chambers 214, 212, as will be discussed in more detail below.

The tool positioning device 200 also includes an extendable wire bundle 238 that electromechanically couples the motor 206 to the tool 201 to provide electrical control (for example, power and control signals) to the tool 201. Example embodiments of the wire bundle 238 include a telescopic tube, a spiral (for example, coiled) cord, a loaded spring with elastic cord, and a driven wire harness.

The housing 202 of the tool positioning device 200 carries the anchor 204, and the anchor 204 is securable to the wellbore 203 at attachment elements 230 to provide a fixed axial position (for example, a reference position) of the tool positioning device 200 (for example, a fixed position of the housing 202) relative to the wellbore 203. In some embodiments, the anchor 204 may include a dedicated actuating motor that is separate from the motor 206. Example attachment elements 230 include anchoring arms that may include pads or may include pistons that have biting elements to enhance attachment to the wellbore 203. The motor 206 is rigidly attached to the anchor 204, and the screw 208 is axially fixed with respect to the motor 206. The control system 234 is located at or above a surface 213 of the rock formation 211 and is coupled to the motor 206, as discussed above with respect to the control system 134 at the rock formation 111.

In operation of the tool positioning device 200, the motor 206 (for example, which may be coupled to a gearbox) is controlled by the control system 234 to rotate (for example, spin) the screw 208 about a central axis 232 of the screw 208 (for example, coinciding with a central axis of the tool positioning device 200). The control system 234 measures a rotational movement of the screw 208 such that the rotational movement of the screw 208 is converted to translational movement (for example, vertical axial movement) of the nut 210 along the screw 208. The vertical displacement of the nut 210 is controlled by a number of revolutions that the screw 208 rotates about the axis 232 and by a known thread pitch of the screw 208. The number of revolutions can be measured by a rotation encoder. Accordingly, a length of the screw 208 determines a total extent to which the nut 210 can move axially, and the thread pitch of the screw 208 determines a distance by which the nut 210 can move axially per revolution of the screw 208.

FIGS. 7-9 respectively illustrate the test probe 207 of the tool 201 at three different vertical positions (for example, formation bed depths) 215, 217, 219 within the wellbore 203. As the nut 210 moves axially away (for example, downward) from the motor 206, the wire bundle 238 extends to remain in contact with the tool 201. Furthermore, as the nut 210 moves axially away from the motor 206, a volume oil within the lower fluid chamber 214 also increases (for example, according to a volume of the screw 208 that is no longer disposed within the nut 210), a volume of the upper fluid chamber 212 increases, and the piston 228 shifts downward such that a volume of the fluid reservoir 216 decreases. Accordingly, as the piston 228 shifts downward to equalize the pressure of the oil 218 and the pressure of the wellbore fluid 209, oil 218 within the fluid reservoir 216 is forced to flow downward through the upper fluid channels 224 into the upper fluid chamber 212, and oil 218 within the lower fluid chamber 214 is forced to flow upward through the lower fluid channels 226 into the upper fluid chamber 212.

The housing 202 of the tool positioning device typically has an outer diameter of about 8 cm to about 15 cm and a wall thickness of about 0.5 cm to about 1.5 cm. The upper and lower fluid channels 224, 226 typically have a diameter of about 0.5 mm to about 5 mm. The screw 208 typically has an operational length (for example, a length along which the nut 210 can translate) of about 0.5 m to about 2.5 m. The total volume of oil 218 within the tool positioning device 200 (for example, a total volume of the fluid chambers 212, 214 and the fluid reservoir 216) typically falls within a range of about 10 L to about 50 L. The screw 208 and the nut 210 are formed of the same materials as those discussed above with respect to the screw 108 and the nut 110.

Figure 10:
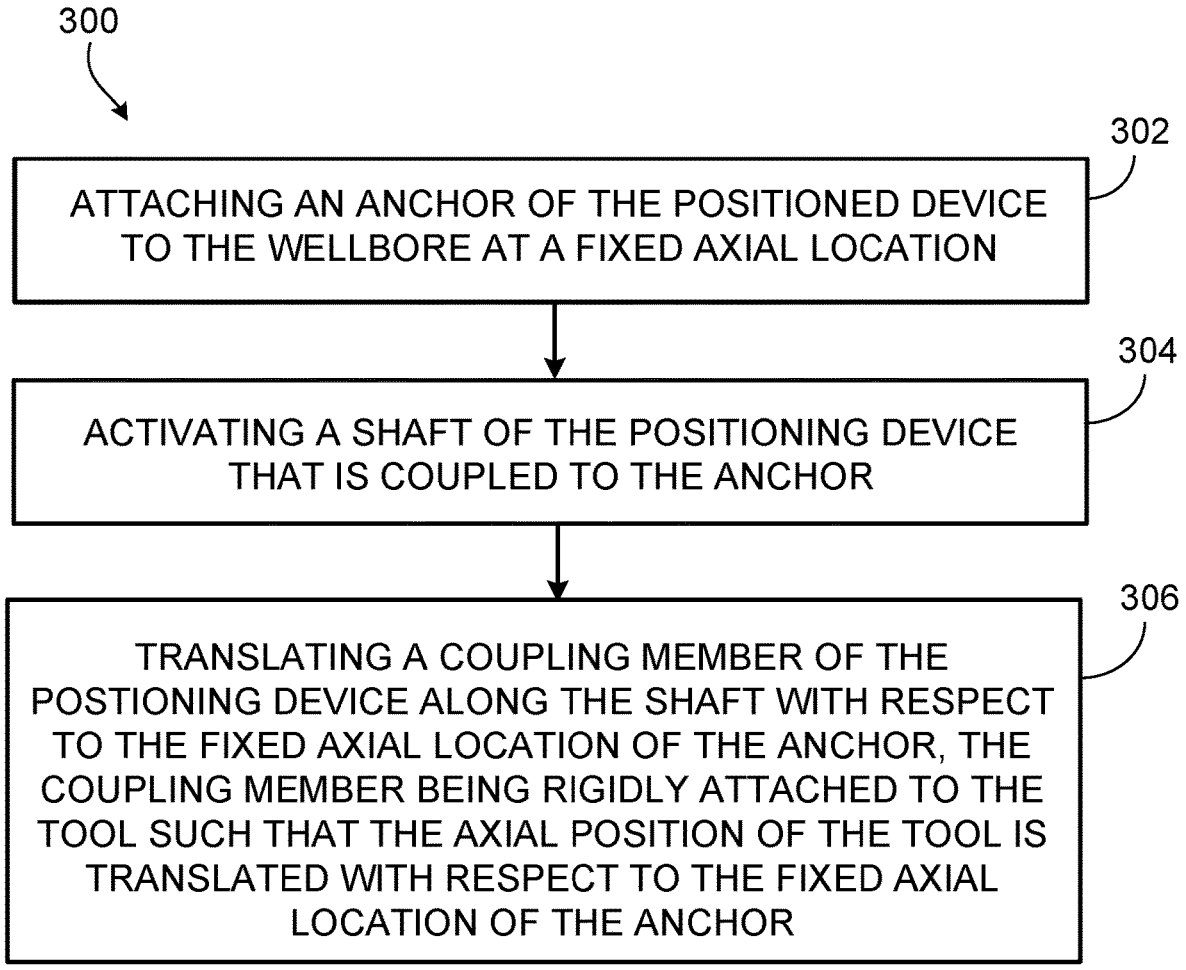
FIG. 10 is a flow chart illustrating an example method of operating a tool positioning device to adjust an axial position of a tool within a wellbore.

FIG. 10 is a flow chart illustrating an example method 300 of operating a positioning device (for example, the tool positioning device 100, 200) to adjust an axial position of a tool (for example, the tool 101, 201) within a wellbore (for example, the wellbore 103, 203). In some embodiments, the method 400 includes attaching an anchor (for example, the anchor 104, 204) of the positioning device to the wellbore at a fixed axial location (302). In some embodiments, the method 300 further includes activating (for example, rotating) a shaft (for example, a shaft of the screw 108, 208) of the positioning device that is coupled to the anchor (304). In some embodiments, the method 400 further includes translating a coupling member (for example, the nut 110, 210) of the positioning device along the shaft with respect to the fixed axial location of the anchor, the coupling member being rigidly attached to the tool such that the axial position of the tool is translated with respect to the fixed axial location of the anchor (306). In some instances (for example, when the screw 108, 208 is activated via the motor 106, 206), activation of the shaft drives translation of the coupling member. In other instances (for example, when the nut 110 is moved via the winch 140), translation of the coupling member drives activation of the shaft.

The tool positioning devices 100, 200 can be operated to precisely control a depth (for example, on the order of a few centimeters) of a tool within a wellbore at a precision that is not attainable via conventional positioning devices that allow for adjustments in only fixed increments or that do not allow for fine position adjustments. Such precise depth control afforded by the tool positioning devices 100, 200 may be particularly advantageous in cases where periodic tool movement is required, where a tool needs to be moved from a desired depth due to a stationary time limit (for example, to avoid becoming stuck in position in a formation) and subsequently returned to the precise previous depth, where a wellbore is deep or deviated, where testing of laminated reservoirs is needed, where testing near bed boundary reservoirs is needed, and where formation bed layers are thin. Accordingly, use of the tool positioning devices 100, 200 can significantly reduce testing uncertainty that may otherwise result from formation pressure gradients, formation bed thicknesses, and distributions of permeable beds within finely laminated formations. As a result, using the tool positioning devices 100, 200 to change a position of a tool within a wellbore can significantly enhance an efficiency of logging operations and an accuracy of logging test results. In many circumstances, it is very advantageous to position a tool relative to a selected reference spot rather than relative to an absolute depth. For example, an absolute depth of the tool may not be controlled accurately enough due to imprecisions in a depth encoding system and mechanical phenomena, such as cable creep, drill string stretching, etc.

While the above-discussed tool positioning devices 100, 200 have been described as including certain dimensions, sizes, shapes, arrangements and materials, in some embodiments, tool positioning devices that are substantially similar in construction and function any of the tool positioning devices 100, 200 may include one or more different dimensions, sizes, shapes, arrangements, and materials.

For example, in some embodiments, a tool positioning device that is substantially similar in construction and function to the tool positioning device 100 may include an extendable wire bundle (for example, one similar to the extendable wire bundle 238) that electromechanically couples the motor 106 to the tool 101 to provide electrical control (for example, power and control signals) to the tool 101. In some examples, such an extendable wire bundle may pass through the screw 108 or may not pass through the screw 108.

Other embodiments are also within the scope of the following claims.

What is claimed is:

1. A positioning device for adjusting a vertical position of a tool within a wellbore, the positioning device comprising:
- an anchor configured for attachment to the wellbore at a fixed vertical location within the wellbore;
- a shaft coupled to the anchor;
- a coupling member to which the tool is attached, the coupling member configured to be translated along the shaft to adjust the vertical position of the tool with respect to the fixed vertical location of the anchor within the wellbore; and
- a housing that carries the anchor,
- wherein the housing defines a first fluid chamber located between the anchor and the coupling member, and wherein the coupling member defines an interior region that provides a second fluid chamber that is fluidically coupled to the first fluid chamber.

2. The positioning device of claim 1, wherein the positioning device is configured such that the coupling member is translatable at a centimeter-scale resolution along the shaft to precisely adjust the vertical position of the tool.

3. The positioning device of claim 1, wherein the shaft comprises a plurality of threads by which the coupling member is secured to the shaft.

4. The positioning device of claim 3, further comprising a motor configured to rotate the shaft, the motor being directly attached to the anchor.

5. The positioning device of claim 4, wherein the positioning device is configured such that a rotational movement of the shaft causes a vertical movement of the coupling member.

6. The positioning device of claim 1, further comprising a piston that cooperates with the housing to define a fluid reservoir that is fluidically coupled to the first and second fluid chambers.

7. The positioning device of claim 6, further comprising oil disposed within the fluid reservoir and within the first and second fluid chambers.

8. The positioning device of claim 7, wherein a first volume of the first fluid chamber is variable and a reservoir volume of the fluid reservoir is variable.

9. The positioning device of claim 8, wherein a total volume of the oil within the fluid reservoir and within the first and second fluid chambers is fixed.

10. The positioning device of claim 8, wherein the first volume increases as the reservoir volume decreases, and wherein the first volume decreases as the reservoir volume increases.

11. The positioning device of claim 10, wherein the piston is movable vertically to equalize a first pressure of the oil and a second pressure of a wellbore fluid within the wellbore that is isolated from the oil by the piston within the positioning device.

12. The positioning device of claim 1, wherein the vertical position defines a vertical depth within the wellbore.

13. The positioning device of claim 1, wherein the shaft is located above the anchor such that the tool is located above the positioning device.

14. The positioning device of claim 1, wherein the shaft is located below the anchor such that the tool is located below the positioning device.

15. The positioning device of claim 14, further comprising an extendable member that extends along the shaft and provides electrical signals to the tool.

16. The positioning device of claim 1, wherein the coupling member comprises a nut that surrounds the shaft.

17. The positioning device of claim 1, wherein the positioning device is configured to be motor-activated.

18. The positioning device of claim 1, wherein the positioning device is configured to be winch-activated.

19. A method of operating a positioning device to adjust a vertical position of a tool within a wellbore, the method comprising:
- attaching an anchor of the positioning device to the wellbore at a fixed vertical location, the anchor being carried by a housing of the positioning device;
- activating a shaft of the positioning device that is coupled to the anchor;
- translating a coupling member of the positioning device along the shaft with respect to the fixed vertical location of the anchor, the coupling member being attached to the tool such that the vertical position of the tool is translated with respect to the fixed vertical location of the anchor; and
- while translating the coupling member:
  - changing a first volume of a first fluid chamber defined by the housing and located between the anchor and the coupling member, and
  - changing a second volume of a second fluid chamber defined by an interior region of the coupling member, the second fluid chamber being fluidically coupled to the first fluid chamber.

20. A positioning device for adjusting a vertical position of a tool within a wellbore, the positioning device comprising:
- an anchor configured for attachment to the wellbore at a fixed vertical location within the wellbore;
- a shaft coupled to the anchor; and
- a coupling member to which the tool is attached, the coupling member configured to be translated along the shaft to adjust the vertical position of the tool with respect to the fixed vertical location of the anchor within the wellbore,
- wherein the shaft is located above the anchor such that the positioning device is located below the tool.

* * * * *